US007367535B2

(12) United States Patent
Lai

(10) Patent No.: US 7,367,535 B2
(45) Date of Patent: May 6, 2008

(54) STRUCTURE OF A SHOWER ROOM HANGER

(76) Inventor: Ming-Hsiao Lai, No. 8, Kung Chi 2 Lane, Ta Tsuen Hsiang, Chang-Hua Hsien (TW)

( * ) Notice: Subject to any disclaimer, the term of this patent is extended or adjusted under 35 U.S.C. 154(b) by 211 days.

(21) Appl. No.: 11/323,704

(22) Filed: Dec. 30, 2005

(65) Prior Publication Data

US 2006/0175496 A1 Aug. 10, 2006

(30) Foreign Application Priority Data

Jan. 4, 2005 (TW) ..... 94200080 U

(51) Int. Cl.
*A47H 1/14* (2006.01)

(52) U.S. Cl. ..... 248/251; 211/105.1

(58) Field of Classification Search ..... 248/222.52, 248/251, 261, 262, 267, 316.8; 211/119.004, 211/105.1, 123, 182, 16, 88.04; 4/576.1, 4/558, 559; D6/524, 363, 380
See application file for complete search history.

(56) References Cited

U.S. PATENT DOCUMENTS 5,875,903 A * 3/1999 Chen ..... 211/105.1
6,220,460 B1 * 4/2001 Pan ..... 211/87.01
6,430,759 B1 * 8/2002 Beltran ..... 4/576.1
6,651,830 B2 * 11/2003 Pan ..... 211/105.1
6,796,442 B1 * 9/2004 Wu ..... 211/105.1
6,817,044 B1 * 11/2004 Ouyoung ..... 4/576.1
6,896,228 B1 * 5/2005 Lu ..... 248/205.8

* cited by examiner

*Primary Examiner*—Gwendolyn Baxter
(74) *Attorney, Agent, or Firm*—Egbert Law Offices

(57) ABSTRACT

The structure of the hanger mount for a shower room includes a wall mount, base and hanger connector. There is a rotatable bolt seat that can be placed on the external end of the protruding bar on the wall mount pivotally, and a groove is placed on one side of the rotatable bolt seat. The through opening on the external end of the base is for the rotatable bolt seat to go through the external surface of the base, and a protruding block is placed on one side of the through opening that can be connected to the grooves of the rotatable bolt seat, driving the base and the rotatable bolt seat. A screw hole can be screwed in with the rotatable bolt seat, having a perfect look without holes and simplifying the structure so that assembling is more convenient and practical.

6 Claims, 8 Drawing Sheets

STRUCTURE OF A SHOWER ROOM HANGER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a structure of a shower room hanger and more particularly to a new structure with a wall mount, base and hanger connector.

BACKGROUND OF THE INVENTION

The conventional structures of a shower mount are mostly positioned by screws and pins, as seen in FIGS. 4 and 5 and disclosed in Taiwan Patent No. 399686 for structure thereof. This conventional structure usually causes the hanger mount for the shower to show the head of the screws and the holes for the screws on one side, which affects the look and value of the product tremendously. In terms of assembling, it is not convenient because it must rely on hand tools.

Thus, to overcome the aforementioned problems of the prior art, it would be an advancement in the rt to provide an improved structure that can significantly improve the efficacy of the device.

To this end, the inventor has provided the present invention of practicability after deliberate design and evaluation based on years of experience in the production, development and design of related products.

BRIEF SUMMARY OF THE INVENTION

The improved factors of the present invention are described herein.

The present invention uses a rotatable bolt seat 20 that is placed on the external end of the protruding bar of the wall mount 10. Corresponding to the through opening at the external end of the base 30, there is a protruding block 34 that can be locked in with the grooves 21 of the rotatable bolt seat. The screw hole 42 inside the hanger connector 42 can be screwed with the rotatable bolt seat to achieved the following functions.

1. It has a perfect look without the holes and screw heads showing, and has high quality.

2. There are only a wall mount 10, base 30 and hanger connector 40, three parts, when it is disassembled, and the rotatable bolt seat 20 is connected to the wall mount 10. Therefore, the structure of the present invention is more simplified, and it does not need any tools to assemble it during the assembling process.

The new function of the present invention is described herein.

A middle mount 60 is placed between the base and the hanger connector, and by structural design, the middle mount drives the rotatable bolt seat 20 to make the base 30 stay on the wall when assembling and to prevent the friction between the surfaces and make the rotation more smooth.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

As shown in FIGS. 1-4, there is a preferred embodiment of an improved structure of shower room hanger.

Figure 1:
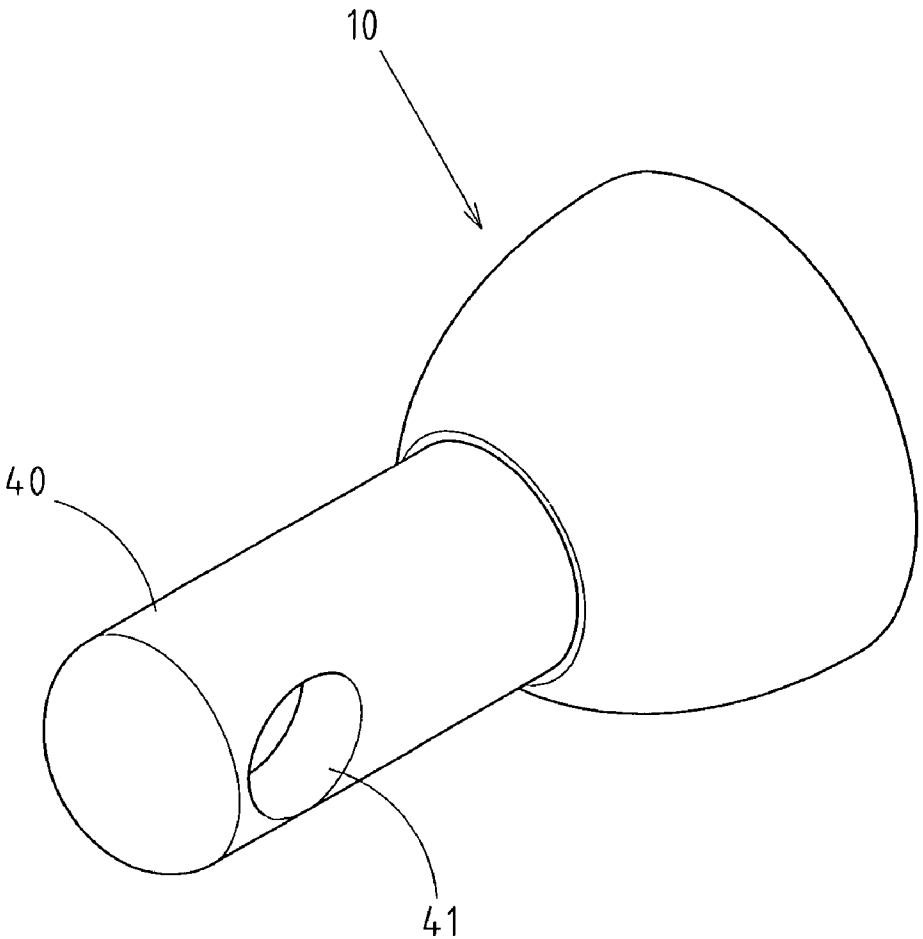
FIG. 1 shows an assembled perspective view of the present invention.
Figure 2:
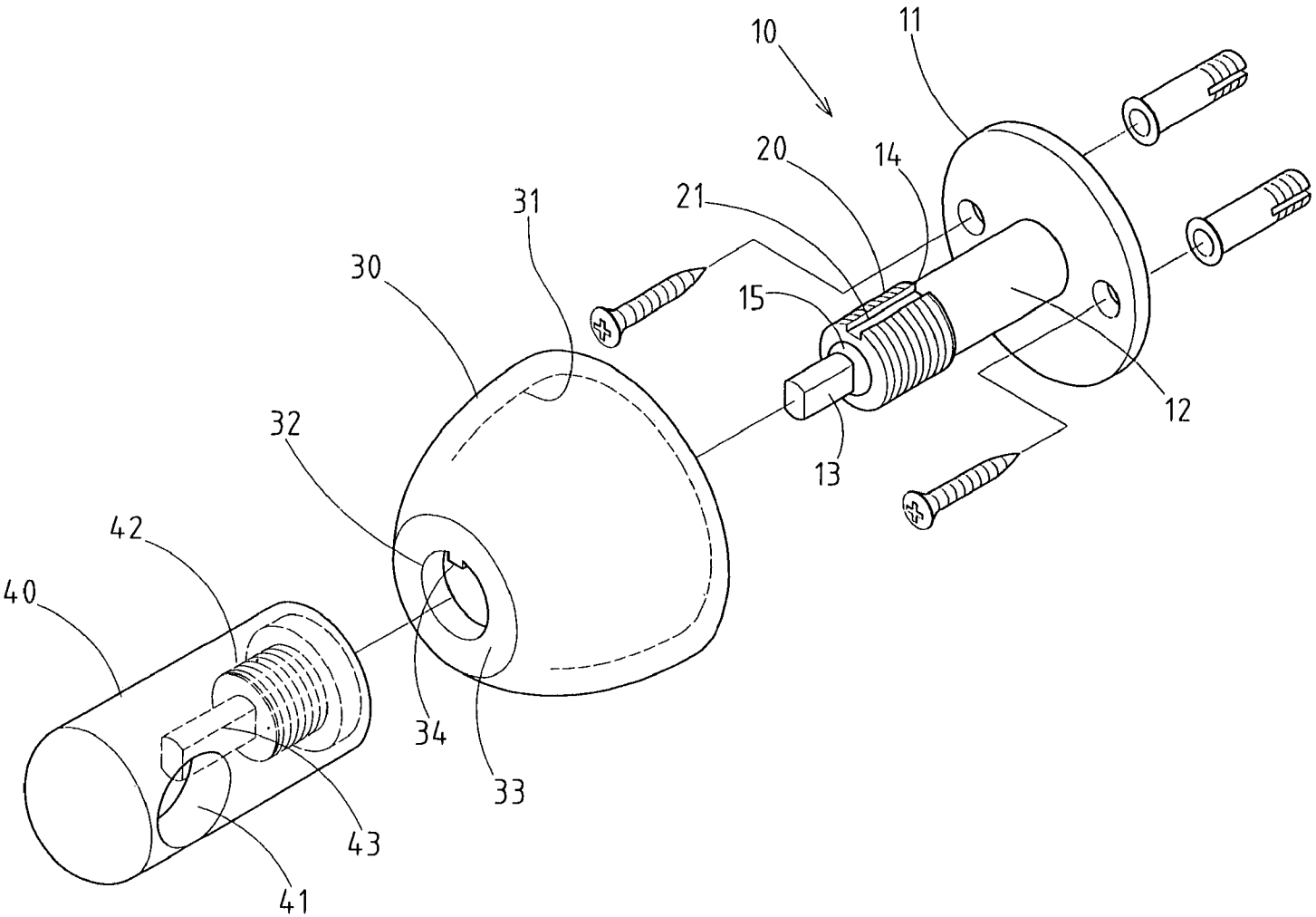
FIG. 2 shows an exploded perspective view of the present invention.
Figure 3:
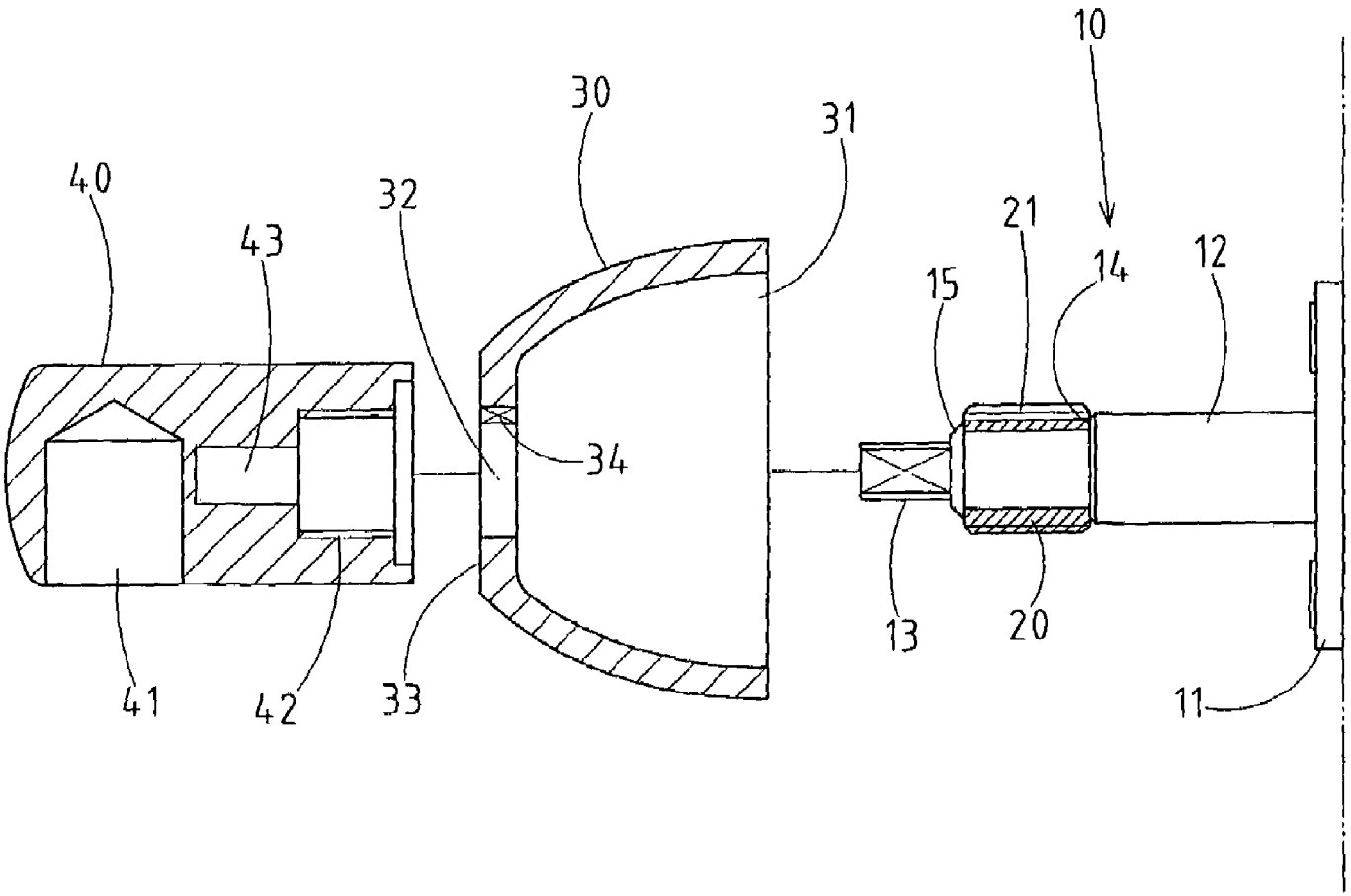
FIG. 3 shows an exploded sectional view of the present invention.
Figure 4:
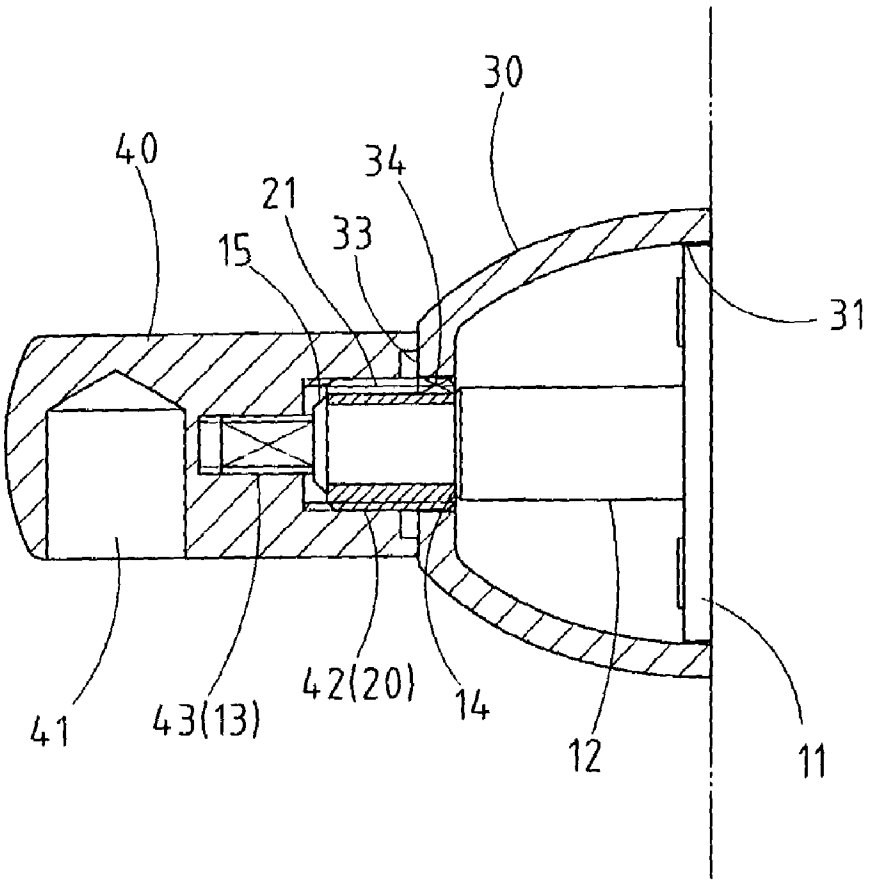
FIG. 4 shows an assembled sectional view of the present invention.

A wall mount 10 has around disc-like wall positioning disc 11 and a protruding bar 12 on the external end of the wall positioning disc. A directional inset 13 is placed on the external end of the protruding bar, and the styles of the directional inset may be classified in different styles, as shown in FIG. 3, which is a plane sectional shape on both sides of a round bar.

A rotatable bolt seat 20 is mounted pivotally on the end of the protruding bar 12 before the directional insert 13 on the wall mount 10, and its inner and outer ends are limited by the blocking edges 14 15 of the protruding bar 12. A counterpart 21 is placed on at least one side of the rotatable bolt seat 20, and the counterpart can be a groove. The grooves go around the rotatable bolt seat 20, and the sectional surface can be made into rectangle groove.

A base 30 is hollow inside, and its inner opening 32 fits the wall positioning disc 11 of the wall mount 10. The external end of the base 30 has a through opening 31 for the rotatable bolt seat 20 on the protruding bar 12 of the wall mount 10 to extend and show the external surface 33 of the base 30. Moreover, the through opening 32 of the external end of the base 30 has a driving section 34 on one side, and the driving section can be a protruding block. The protruding block can be one end protruding rectangle for one side of the through opening, which can be locked into with the counterpart 21 of the rotatable bolt seat 20. By so doing, the block is able to drive the base 30 and to rotate the rotatable bolt seat 20.

A hanger connecter 40 has a hanger connection part 41 on the external end, and a screw hole 42 is placed on the internal end 42 to be screwed with the rotatable bolt seat 20 that extends to the through opening 32 of the base. A directional slot 43 is placed in the internal end of the screw hole 42 for the directional inset 13 of the protruding bar 12 on the wall mount to connect.

Through the above structure and design, when the hanger mount for the shower disclosed by the present invention is assembled, the wall mount 10 shall be placed on the wall first, and the base 30 connects to the wall mount 10 so that the inner opening 3 of the base 30 is placed on the wall positioning disc 11 of the wall mount 10. The rotatable bolt seat 20 of the protruding bar 12 of the wall mount 10 goes through the external surface 33 of the base 30. The end of the hanger connector 40 that has screw hole 42 in the direction towards rotatable bolt seat 20 is connected, and at this time, the directional slot 43 and the directional insert 13 are connected to each other so that the hanger connector 40 is limited. At this time, one hand is used to hold the hanger connector 40 and the other hand is used to turn the base 30 so that it drives the rotatable bolt seat 20 at the same time. The rotatable bolt seat 20 is screwed to the screw hole 42 gradually so that the hanger connector 40 is pushing towards the external surface 33 of the base 30 until it is tight, the hanger connector 40, base 30 and the wall mount 10 being positioned.

Figure 5:
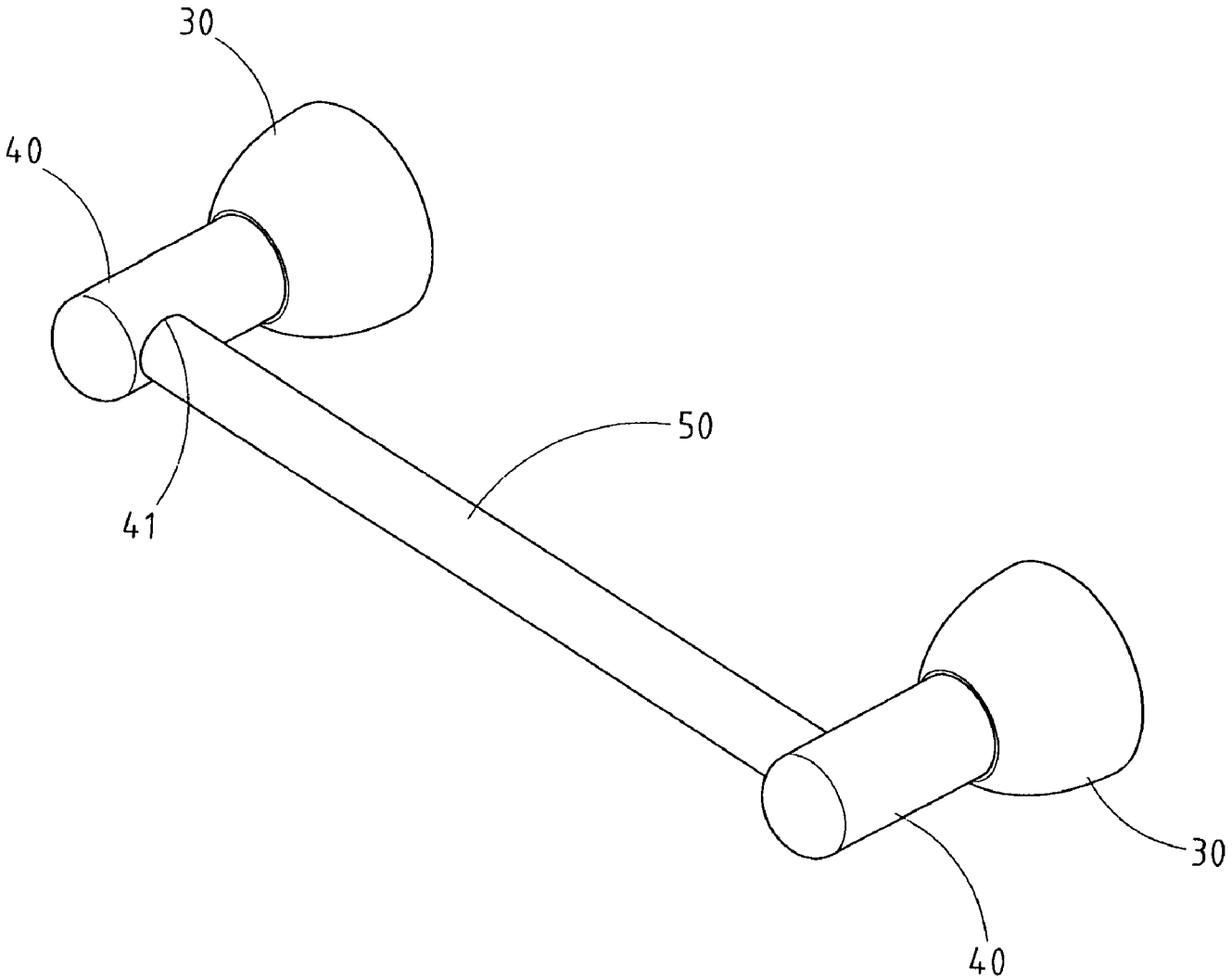
FIG. 5 shows the embodied sectional view of the hanger of the present invention.

Moreover, the style of the hanger mount for shower room disclosed in the present invention is not limited. As shown in FIG. 5, the hanger is a horizontal bar 50 so that the hanger connector 41 on the external end of the hanger connector 40 is a hole for the horizontal bar 50 to pin the position.

Figure 6:
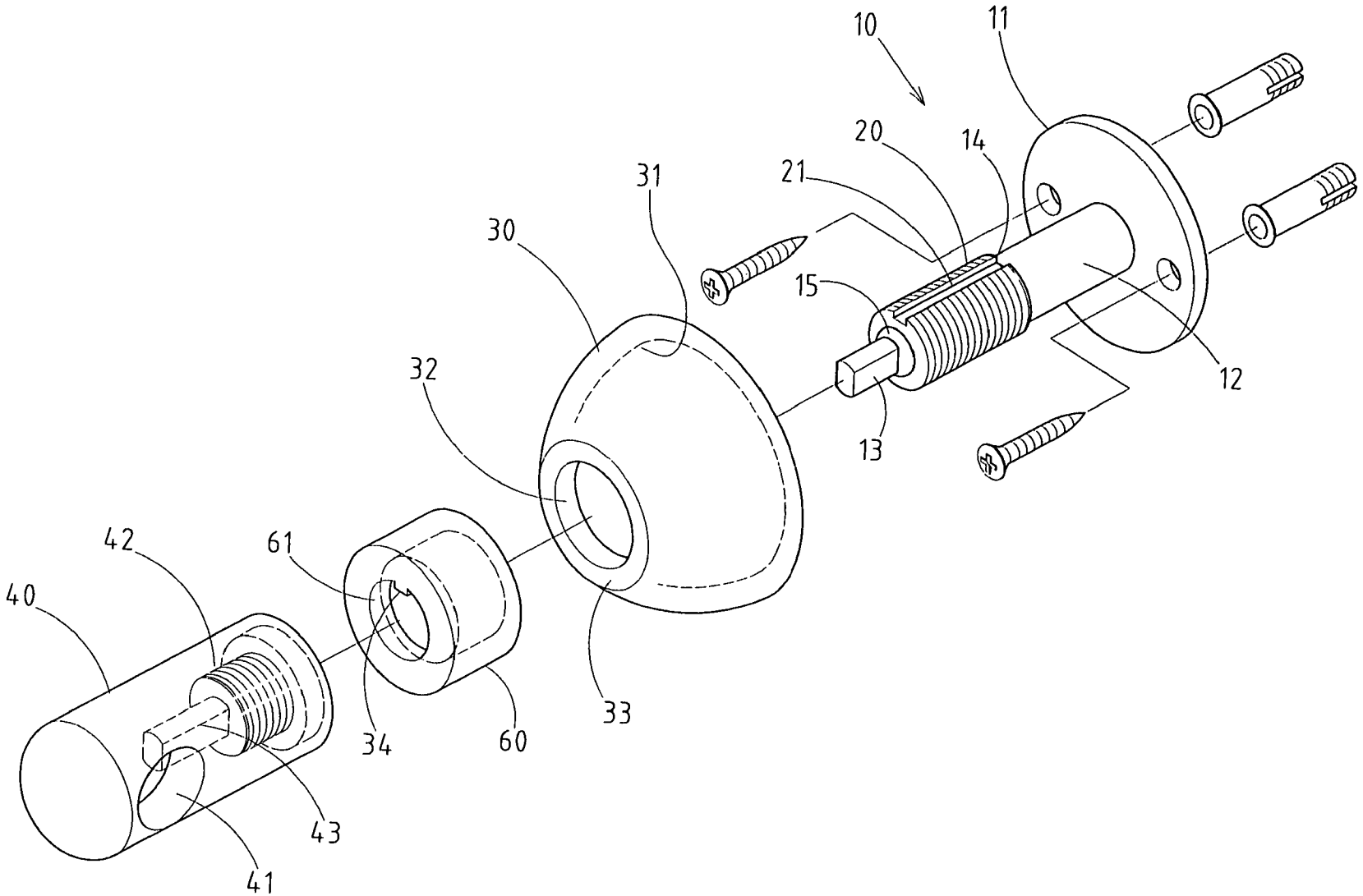
FIG. 6 shows an exploded perspective view of another embodiment of the present invention.
Figure 7:
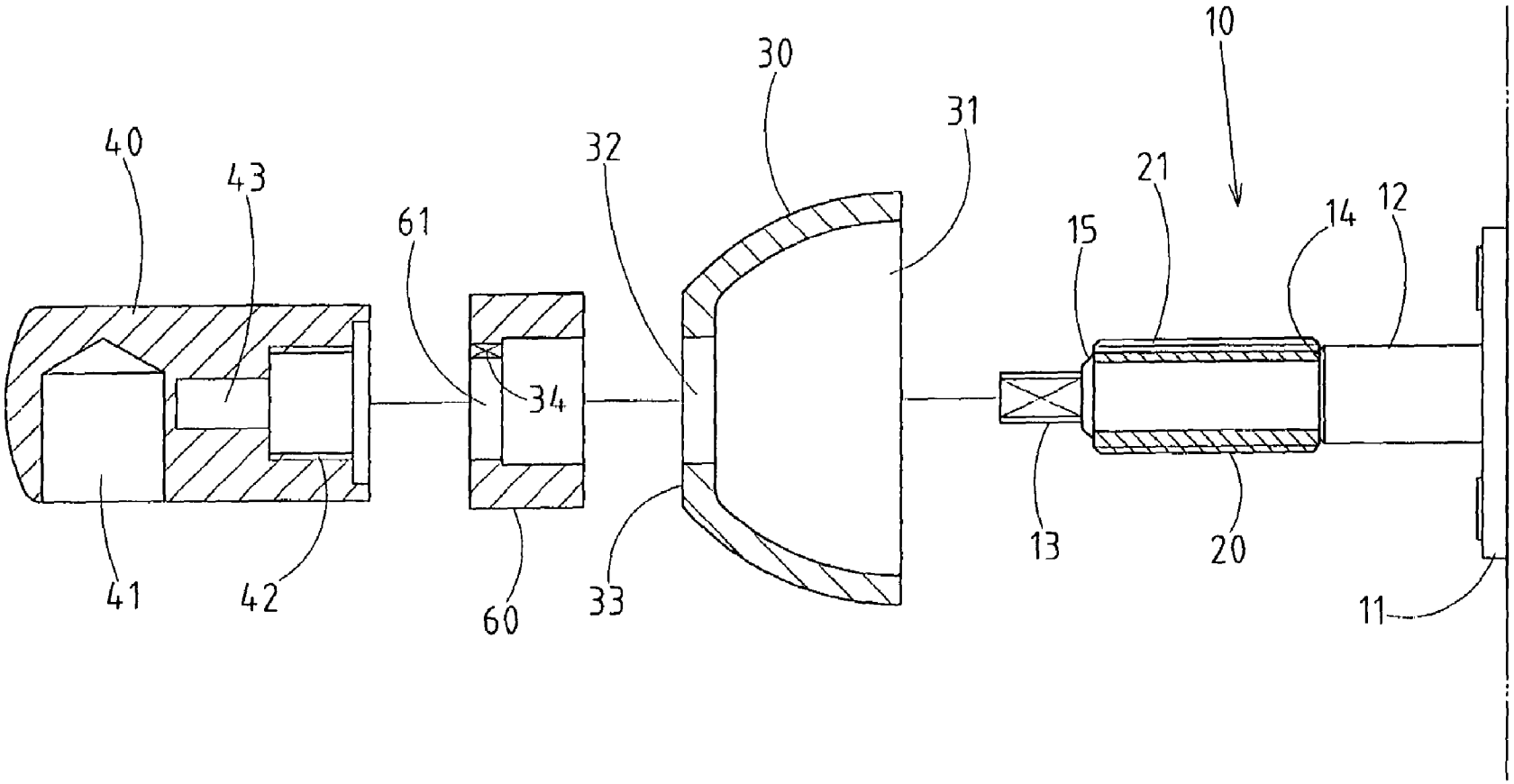
FIG. 7 shows an exploded sectional view of another embodiment of the present invention.
Figure 8:
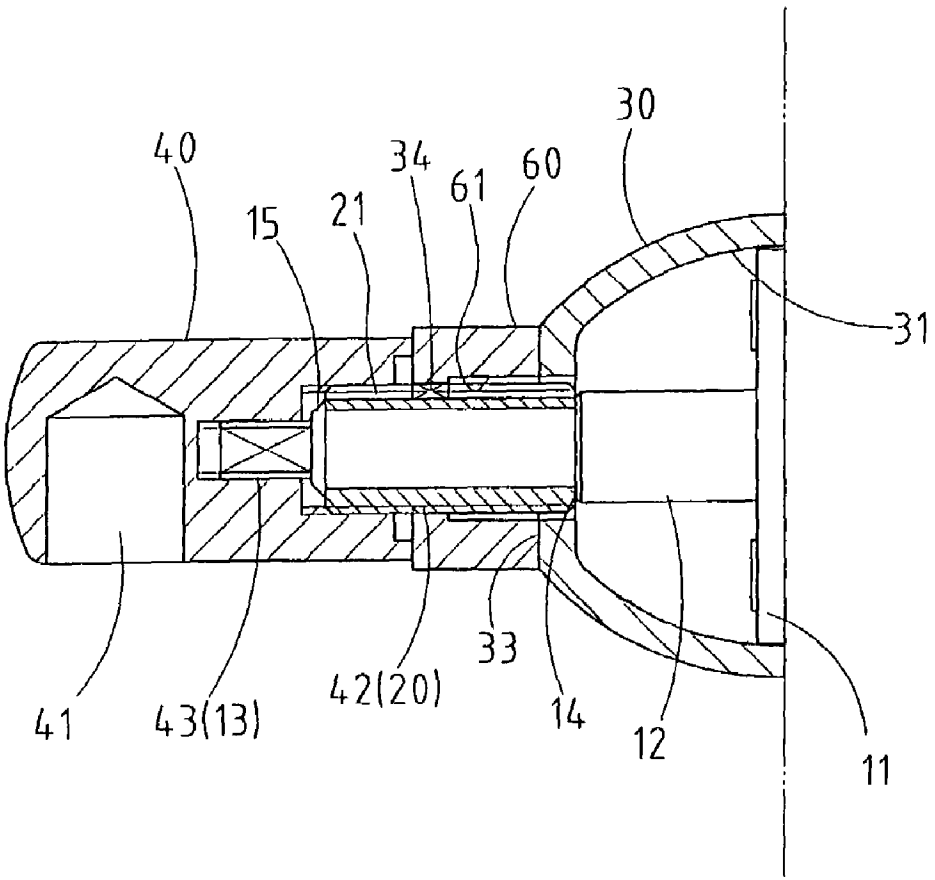
FIG. 8 shows an assembled sectional view of another embodiment of the present invention.

As shown in FIGS. 6, 7, 8, there is another embodiment of the structure of the hanger mount for the shower room. The differences are presented herein.

A middle mount 60 is placed in between the base 30 and the hanger connector 40, and the center of the middle mount has a through hole 61 so that the driving section 34 that was originally placed in the through opening 32 of the base is on at least one side of the through hole 61 for coordination with the counterpart of the rotatable bolt seat 20 that is placed pivotally with the protruding bar 12 of the wall mount 10. By so doing, the middle mount 60 is turned and the rotatable bolt seat 20 is driven at the same time. The base 30 can be kept against the wall at this time, and the rotatable bolt seat 20 and the screw hole 42 are screwed together gradually so that the hanger connector 40 is pushed towards the external surface of the middle mount 60. The middle mount is pushed towards the base 30 until tight. At this time, the hanger connector 40, middle mount 60, base 30 and the wall mount 10 are positioned.

I claim:

1. A structure of shower room hanger comprising:

a wall mount having a wall positioning disc with a protruding bar extending outwardly therefrom;

a base having an inner opening at one end thereof, said base having a hollow interior, said inner opening fitting on said wall positioning disc of said wall mount, said base having a through opening at an opposite end thereof, said protruding bar extending through said through opening;

a hanger connector positioned on said opposite end of said base, said hanger connector having an interior affixed to said protruding bar of said wall mount; and a rotatable bolt seat fixed onto an end of said protruding bar opposite said wall positioning disc, said bolt seat having a counterpart on one side thereof, said bolt seat extending through said through opening of said base, said through opening of said base having a driving section on one side thereof received by said counterpart of said bolt seat, said hanger connector having a screw hole formed in said interior thereof, said screw hole threadedly engaged with said bolt seat.

2. The structure of claim 1, said wall mount having a directional insert at an end of said protruding bar opposite said wall positioning disc, said hanger connector having a directional slot formed in said interior thereof, said directional slot receiving said directional insert therein.

3. The structure of claim 1, said counterpart being a groove, said driving section being a protruding block.

4. A structure of shower room hanger comprising:

a wall mount having a wall positioning disc with a protruding bar extending outwardly therefrom;

a base having an inner opening at one end thereof, said base having a hollow interior, said inner opening fitting on said wall positioning disc of said wall mount, said base having a through opening at an opposite end thereof, said protruding bar extending through said through opening;

a hanger connector positioned on said opposite end of said base, said hanger connector having an interior affixed to said protruding bar of said wall mount;

a rotatable bolt seat fixed onto an end of said protruding bar opposite said wall positioning disc, said bolt seat having a counterpart on one side thereof, said bolt seat extending through said through opening of said base; and a middle mount positioned between said base and said hanger connector, said middle mount having a through hole extending centrally therethrough, said middle mount having a driving section extending into said through hole on one side thereof, said driving section received in said counterpart of said bolt seat, said hanger connector having a screw hole formed in said interior thereof, said screw hole threadedly engaged with said bolt seat.

5. The structure of claim 4, said wall mount having a directional insert at an end of said protruding bar opposite said wall positioning disc, said hanger connector having a directional slot formed in said interior thereof, said directional slot receiving said directional insert therein.

6. The structure of claim 4, said counterpart being a groove, said driving section being a protruding block.

* * * * *